US006158987A

United States Patent [19]

Raikamo

[11] Patent Number: 6,158,987

[45] Date of Patent: Dec. 12, 2000

[54] POWER UNIT FOR USE AS A PRESSURE-FLUID OPERATED MOTOR AND/OR A PRESSURE FLUID PUMP

[76] Inventor: Esko Raikamo, Rajasillantie, Fin-33880, Sääksjärvi, Finland

[21] Appl. No.: 09/229,249

[22] Filed: Jan. 12, 1999

Related U.S. Application Data

[60] Provisional application No. 60/071,008, Jan. 13, 1998.

[51] Int. Cl.[7] ..... F03C 4/00

[52] U.S. Cl. ..... 418/36; 418/34; 418/35

[58] Field of Search ..... 418/35, 34, 36

[56] References Cited

U.S. PATENT DOCUMENTS

| | | | |
|---|---|---|---|
| 2,804,059 | 8/1957 | Honjyo | 418/36 |
| 3,396,632 | 8/1968 | Leblanc | 418/36 |
| 3,645,239 | 2/1972 | Cena | 418/34 |
| 3,767,331 | 10/1973 | Klesatschke . | |
| 3,807,368 | 4/1974 | Johnson | 418/36 |
| 3,873,247 | 3/1975 | Boes . | |
| 4,319,551 | 3/1982 | Rubinshtein | 418/35 |
| 4,437,441 | 3/1984 | Menioux | 418/34 |
| 4,646,694 | 3/1987 | Fawcett | 418/36 |
| 4,664,078 | 5/1987 | Bender | 418/34 |
| 4,844,708 | 7/1989 | Lopez . | |
| 4,901,694 | 2/1990 | Sakita | 418/36 |

FOREIGN PATENT DOCUMENTS

| | | |
|---|---|---|
| 93408 | 8/1897 | Germany . |
| 123931 | 10/1901 | Germany . |

*Primary Examiner*—Thomas Denion
*Assistant Examiner*—Theresa Trieu
*Attorney, Agent, or Firm*—Ladas and Parry

[57] ABSTRACT

A power unit for use as a pressure-fluid-operated motor and/or a pressure fluid pump, the power unit comprising a cylinder space, pistons movable in the cylinder space and channels for pressure fluid. The cylinder is annular and the pistons extend radially to the inner circumferential surface of the cylinder space and are arranged to rotate around the axis of the cylinder space. The power unit further comprises a transmission shaft and locking members for successively locking the pistons so that they cannot rotate with respect to the cylinder space. The pistons are alternately locked while pressure fluid is alternately supplied and discharged from chambers between the pistons so that the pistons are rotated in succession either to deliver power as a motor or pressurized fluid as a pump.

18 Claims, 7 Drawing Sheets

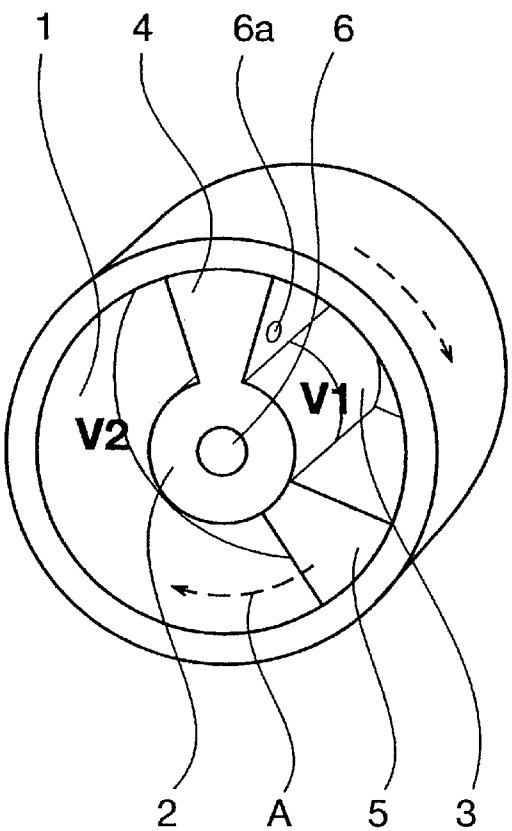
Fig. 1. a
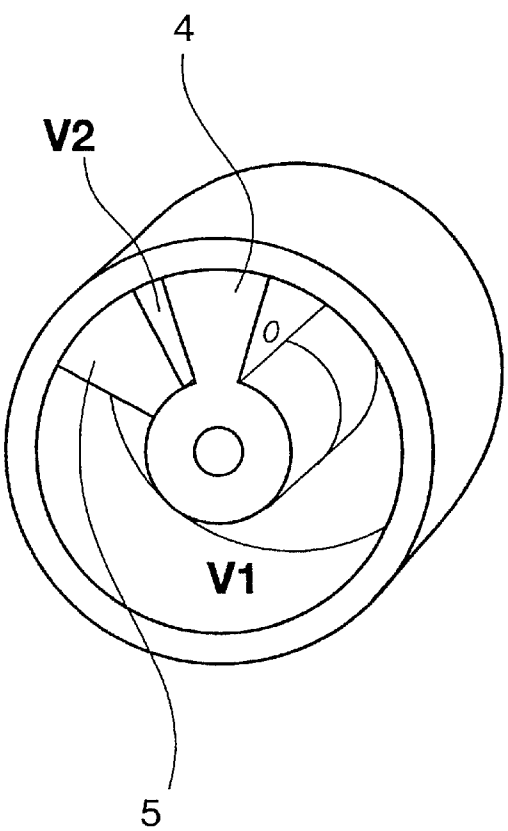
Fig. 1. b
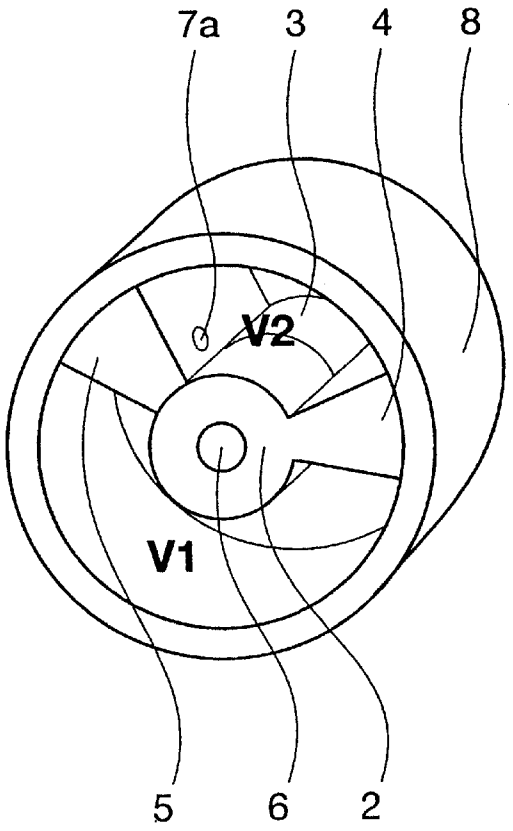
Fig. 1. c

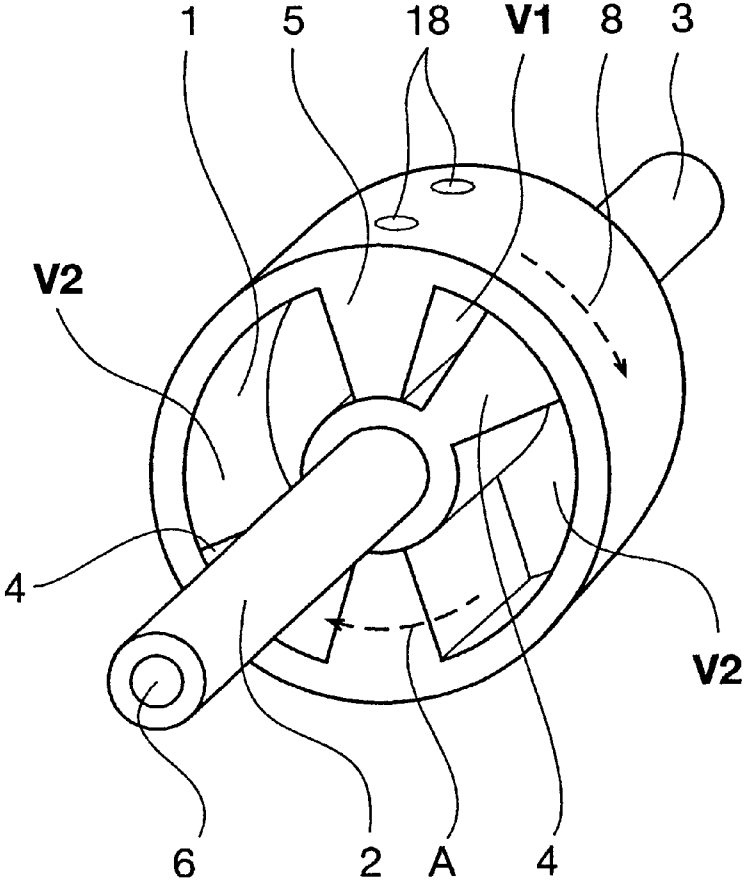
Fig.7. b
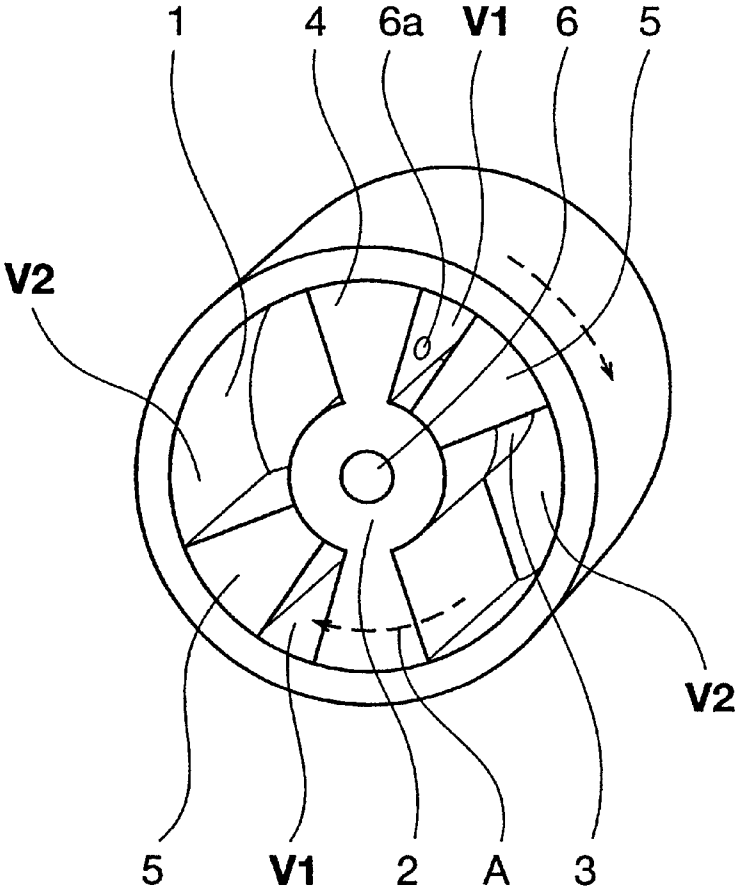
Fig. 7. a

POWER UNIT FOR USE AS A PRESSURE-FLUID OPERATED MOTOR AND/OR A PRESSURE FLUID PUMP

This application claims the benefit of U.S. Provisional No. 60/071,008 filed Jan. 13, 1998.

FIELD OF THE INVENTION

The invention relates to a power unit for use as a pressure-fluid operated motor and/or a pressure fluid pump, the power unit comprising a cylinder space, a piston movable in the cylinder space and channels for pressure fluid, which lead to the cylinder space.

BACKGROUND AND PRIOR ART

Various power units intended to be used as pressure-fluid operated arrangements are widely known, such as pressure-fluid operated motors and pumps. There are various kinds of pressure-fluid operated motors, such as piston motors, screw motors, gear motors and vane motors. Different kinds of pressure fluid pumps are also known, e.g. piston pumps, screw pumps, gear pumps and vane pumps. The same power unit often functions both as the motor and the pump, whereby e.g. a hydraulic pump and a hydraulic motor connected to it may be identical in the same device.

Both the structure and production of power units comprising pistons are usually complicated, and thus they have gaskets and several parts prone to wear. It is rather expensive to produce them, and their service increases the operating costs considerably. In screw-type arrangements, on the other hand, the screw mechanism is expensive and difficult to manufacture. Vane motors and gear motors as well as vane pumps and gear pumps are relatively cheap to produce, but the efficiency of vane-type power units is poor in all respects, and their operation is very inaccurate.

A further problem of the prior art solutions is that when they are used for operating an actuator, it is rather difficult to guide the actuator to a predetermined position accurately, and controlling of a certain alternating working motion, for example, requires additional control systems, which makes the use of the conventional constructions difficult and expensive.

SUMMARY OF THE INVENTION

An object of the present invention is to provide a power unit for use as a pressure-fluid operated arrangement, which is simple and easy to implement, and which can produce an accurate motion in the same way as a stepper motor, if so desired.

The power pressure fluid unit of the invention comprises a pressure fluid power unit comprising an annular casing defining a space therewithin, two radial pistons in said space defining first and second chambers between the pistons, said piston being coaxially rotatable about an axis of said space, channels for conveying pressure fluid into and out of said chambers, transmission shafts respectively secured to said pistons, locking members for alternatively opposing rotation of one piston around said axis while the other piston is free to rotate, and means acting in synchronization with said locking members to obtain alternating successive rotation of said pistons and flow of pressure fluid with respect to said first and second chambers.

The basic concept of the invention is that there is an annular, closed cylinder space around the rotational axis and at least two pistons are arranged to rotate around the axis and are of the shape of the cross section of the annular space, the pistons being arranged to rotate around said axis in such a manner that at least one piston at a time can be arranged to be immobile or retarded in its rotational movement. Another essential concept of the invention is that the channels provide flow of pressure fluid into or out of the part of the cylinder space between the two pistons, as required. When pressure fluid is supplied into one of the spaces between the pistons, one of the pistons is arranged to be immobile or its rotation is retarded, the pressure fluid causes the other piston to move, and the piston causes the associated shaft, which is connected directly or indirectly to rotate in the cylinder space. Correspondingly, when one shaft is rotated, it moves its associated piston and when the other piston is immobile or retarded in rotation, pressure fluid flows out of the space between the pistons.

An advantage of the invention is that by using pistons which, if need be, can be arranged to be successively fixed and or to rotate with respect to the axis of the cylinder space, the pistons, it is possible to produce a substantially continuous rotating motion. If a plurality of pistons are arranged to be fixed and movable a deflection angle of a desired degree can be provided, whereby the arrangement functions like a stepper motor. A further advantage of the invention is that by using close clearances between the pistons and the surfaces of the cylinder space, substantially no gaskets are needed. Thus it is possible to provide an arrangement, which is economical to produce and operate.

BRIEF DESCRIPTION OF THE DRAWINGS

The invention will be described in greater detail in the accompanying drawings, in which FIGS. 1*a* to 1*c* schematically illustrate an embodiment implemented according to the operating principles of a power unit of the invention, FIGS. 7*a* and 7*b* are schematic general views of the embodiments of the invention.

DETAILED DESCRIPTION

Figures 2, 2A:
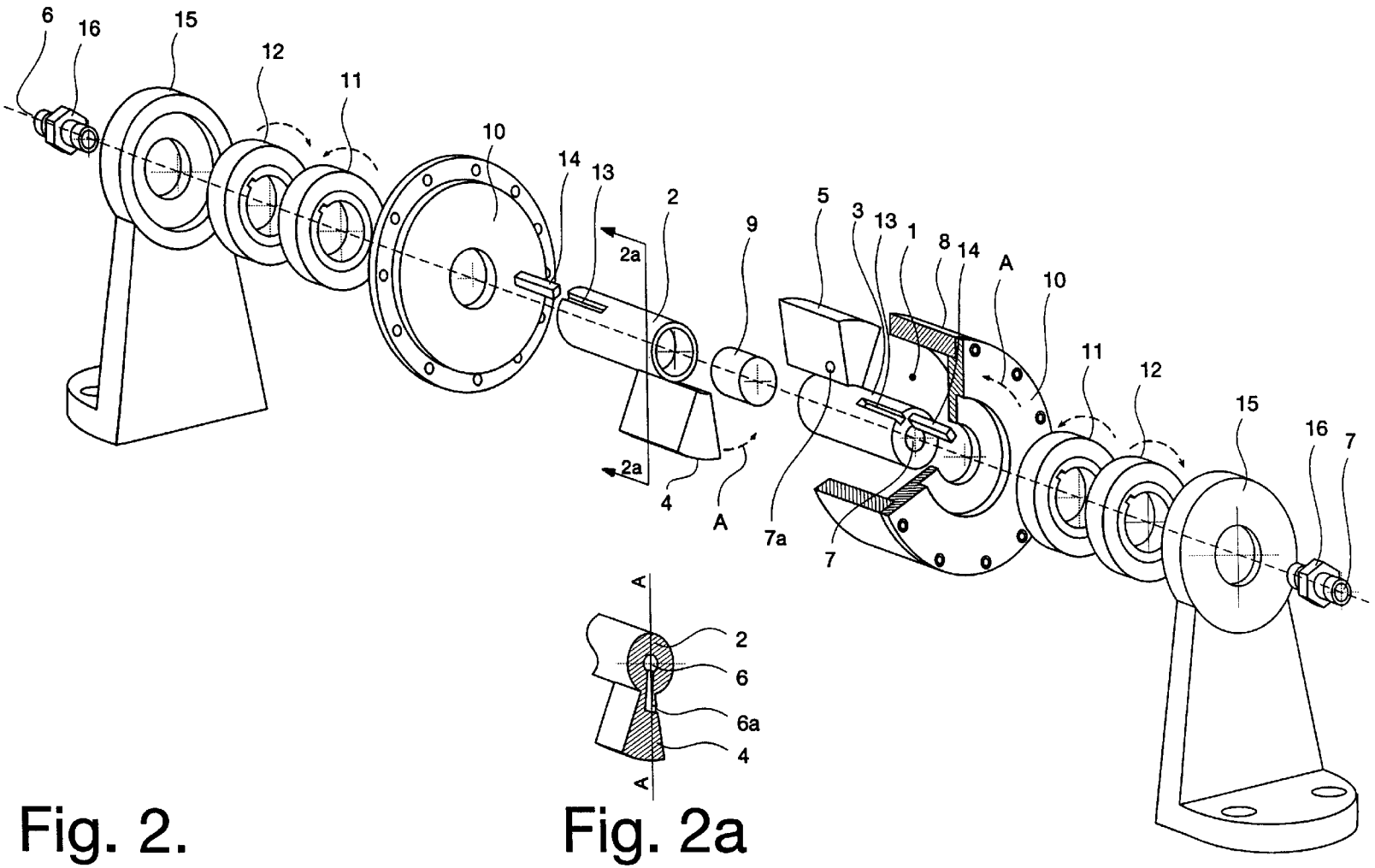
FIG. 2 is a schematic exploded view of the power unit illustrated in FIGS. 1*a* to 1*c*.
FIG. 2*a* is a section of a portion taken along lines 2*a*–2*a* in FIG. 2.

FIGS. 1*a* to 1*c* illustrate schematically the basic structure of the power unit of the invention. The figures show a power unit comprising an annular, closed cylinder space 1. In the cylinder space 1 there is a shaft coaxial within the cylinder space, the shaft being formed by two coaxially rotatable transmission shafts 2 and 3. The cylinder space further contains two radial pistons 4 and 5 extending from their shafts to the inner surface of the cylinder space. The pistons are both non-rotatably connected on their respective transmission shafts 2 and 3. Thus the transmission shaft 2 and piston 4 can rotate with respect to the cylinder space 1 independently of the transmission shaft 3 and piston 5 and vice versa, excluding the situation in which the pistons meet each other during the rotating motion. In principle, the transmission shafts 2 and 3 extend outside the cylinder space 1, and in practice through the end flanges enclosing the cylinder space, so that power can be transmitted through the shafts to the power unit, i.e. to the piston mounted on the shaft in question, or the power generated by the pressure of the pressure fluid acting on the piston can be transmitted from the power unit. For the sake of simplicity the end flanges are not illustrated in FIGS. 1*a* to 1*c*.

A channel 6 goes through the transmission shaft 2 and an opening 6*a* of the channel is shown on the right side of the piston 4 in FIG. 1*a,* i.e. in communication with a chamber or space V1. Similarly, at the end of the transmission shaft 3 (not shown) there is a channel leading to the surface of the piston 5 a chamber or space V2.

When the power unit is used as a hydraulic motor, the piston 4, for example, is first locked so that it cannot rotate, whereafter pressure fluid is fed into chamber V1 of the cylinder space between the pistons 4 and 5 via the channel 6. At the same time the channel in the transmission shaft 3 of piston 5 is open and the pressure of the pressure fluid in chamber V1 causes the piston 5 to move in the direction indicated by arrow A, and the pressure fluid flows out of chamber V2 via the channel in the piston 5. When the piston 5 has moved to the position shown in FIG. 1*b* or is even in contact with the piston 4, the piston 5 is locked so that it cannot rotate and the feed of the pressure fluid is reversed. Namely, as shown in FIG. 1*c* pressure fluid has been fed into the chamber V2 between the pistons 5 and 4 through the transmission shaft 3 and via the opening 7*a* of the piston 5. In this state the pressure fluid pushes the piston 4 forwards in the annular cylinder space, thereby simultaneously rotating the transmission shaft 2 as the pressure fluid discharges into the channel 6 in the transmission shaft 2 of the piston 4 and flows therefrom. By alternating feeding of the pressure fluid with locking of the pistons it is possible to make the pistons rotate successively in the cylinder space 1. This rotating motion can be recovered at the ends of the transmission shafts 2 and 3 and transmitted through them to the device to be operated. Correspondingly, by connecting the shafts appropriately to locking members in a separate body, the casing 8 around the cylinder space 1 can be made to rotate and thus the generated power can be recovered from its rotation. It is also possible to produce a rotating motion, even though one of the pistons is not completely locked so that it cannot rotate, but its rotating motion is retarded, for example, by a brake or by other means.

The function described above can also be reversed, whereby the transmission shaft 2 or 3 is rotated mechanically, which rotates the piston mounted on it. In this case the piston pumps the pressure fluid out of one pressure fluid channel while fluid without pressure flows into the other chamber from the other pressure fluid channel, the power unit of the invention thus functioning as a pump.

FIG. 2 is an exploded view of an embodiment of the power unit according to the invention. The figure shows that the transmission shafts 2 and 3 are connected to the pistons 4 and 5 in such a manner that the pistons 4 and 5 can position themselves by the shaft of one of the pistons. For the transmission shafts to keep their direction and position regardless of the acting forces, there is a supporting shaft 9 arranged between them, the shaft 9 being mounted at the ends of the transmission shafts 2 and 3 in a suitable way. The mounting can be implemented with slide bearings or with other known bearings. The figure further shows end flanges 10, by means of which the annular cylinder space 1 is formed around the transmission shafts 2 and 3 inside the casing 8. The figure also shows one-way clutches 11 and 12 mounted at the ends of the transmission shafts 2 and 3 outside the end flanges 10. Such one-way clutches comprise an inner circumference, an outer circumference and locking members between these surfaces. A one-way clutch functions in such a way that the inner circumference and the outer circumference can freely rotate in one direction with respect to each other, but they are prevented from rotating in the reverse direction by the locking members. One-way clutches of this kind and their structure are widely known per se, and the clutches are freely available, and their structure is not described in great detail in this context.

In this embodiment of the invention the one-way clutches 11 and 12 are mounted on the transmission shafts 2 and 3 in such a manner that the inner circumferences of the one-way clutches are non-rotatable, with respect to the transmission shafts 2 and 3, e.g. with key slots 13 shown in FIG. 2 keys 14 therein. Furthermore, the one-way clutches 11 and 12 are mounted on the transmission shafts 2 and 3 in such a manner that the free rotation directions of the one-way clutches are in reverse. They are further mounted on the shafts in such a manner that on both transmission shafts 2 and 3 the free rotation directions of the one-way clutches 11 situated next to the end flanges 10 are parallel as shown by broken arrows in the FIG. 2. The outer circumference of the one-way clutches 11 is in turn arranged to be non-rotatable with respect to the end flanges 10, and the outer circumferences of the outer one-way clutches 12 are arranged to be non-rotatable with respect to separate fasteners 15. In principle, the fasteners 15 can be part of a uniform body or they can be fastened to the same body or bed so that they are non-rotatable with respect to each other. In some embodiments the transmission shafts can be connected to rotate a device or a shaft alternately by means of suitable gearing or the like. FIG. 2 also shows pressure fluid couplers 16, through which pressure fluid can be fed into and out of the cylinder space 1 via the channels 6 and 7. FIG. 2*a* shows a section of the piston and shaft to illustrate how the channel 6 and the opening 6*a* are interconnected to feed pressure fluid into and out of the cylinder space 1.

Figure 3:
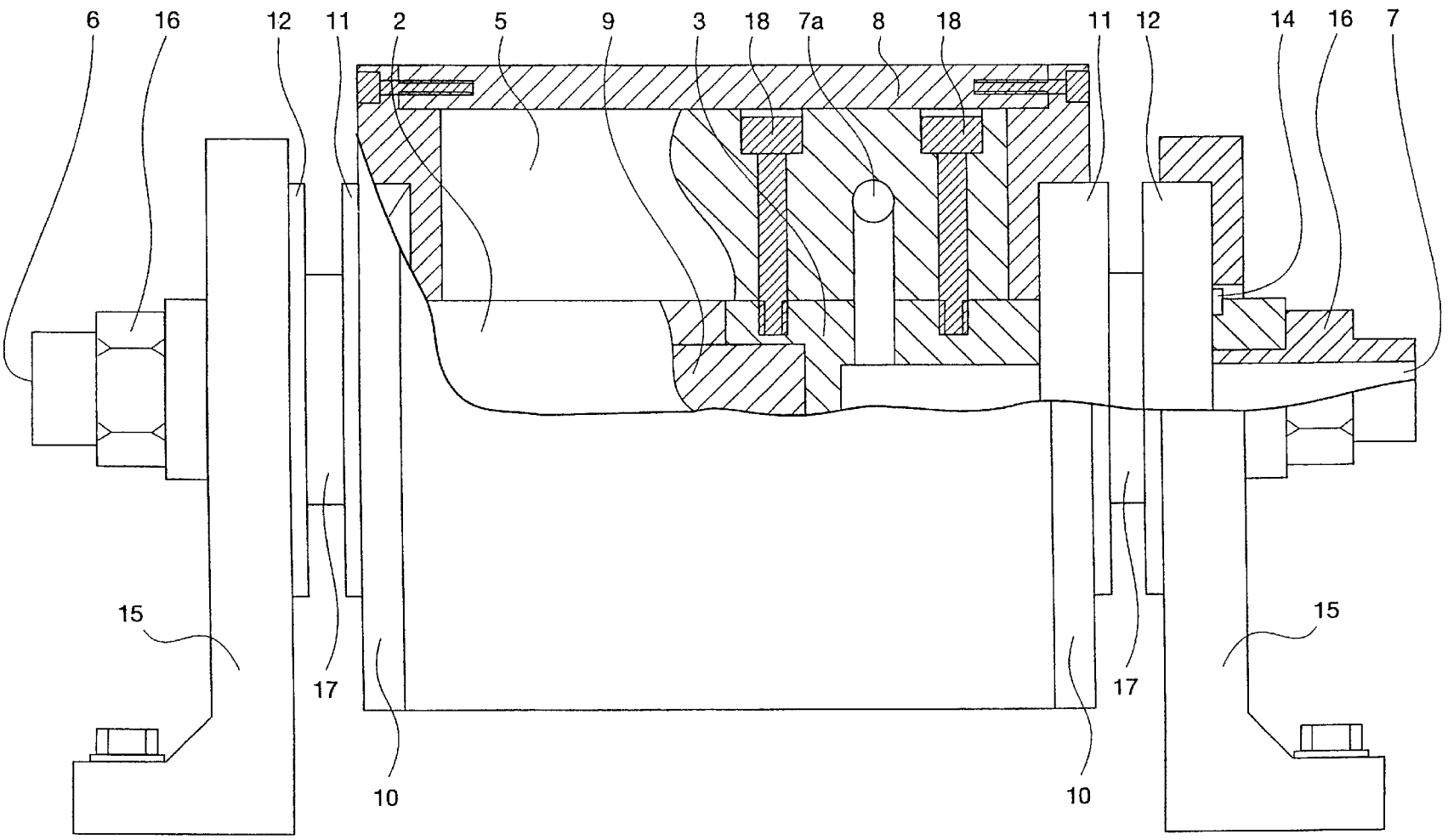
FIG. 3 is a schematic, partially sectional view of the embodiment of the invention shown in FIG. 2 in the direction of the shaft, FIGS. 4*a* to 4*c* schematically illustrate another embodiment of the power unit of the invention.

FIG. 3 is a schematic, partially sectional side view of the embodiment of the invention according to FIG. 2, illustrating the arrangement as assembled. As can be seen in FIG. 3, the casing 8 and the end flanges 10 form the closed annular cylinder space 1 around the transmission shafts 2 and 3. The one-way clutches 11 and 12 on the transmission shafts 2 and 3 are arranged in such a manner that the one-way clutches 12 are fastened to the couplers 15 and the one-way clutches 11 are fastened to the end flanges 10, as shown in FIG. 3. There may be separate spacing rings 17 between the one-way clutches so as to keep them at an appropriate distance from each other, even though the construction can also be implemented otherwise. FIG. 3 also shows key 14 which connects the transmission shaft 3 to the one-way clutches 11 and 12. There is also a corresponding key at the end of the transmission shaft 2, although it is not illustrated in the FIG. 3.

FIG. 3 shows that the piston 5 is of the same shape and size as the cylinder space 1, thus closing the whole cylinder space 1. In this embodiment the piston 5 is fastened to the transmission shaft 3 by fastening bolts 18, which go through the piston 5 surface next to the flange 8 and extend to the transmission shaft 3. There is a channel 7 through the transmission shaft 3, and another one channel extending radially between the opening 7*a* of the piston 5, and the channel 7 to convey the pressure fluid. Since the fastening bolts 18 are in the middle of the piston 5, the outer surface on both sides of the bolt holes of the piston 5 seals the piston with respect to the casing 8. The piston 4 (not shown) and the shaft 2 are interconnected similarly and arranged to function in the same way. In addition to bolt fastening, the pistons can be fastened to their shafts in other ways known per se, provided that the joint between the pistons and the shafts is firm, and the clearances between the different surfaces are small enough not to require seals of otherwise are sealed with suitable gaskets.

In this embodiment feeding pressure fluid into the cylinder space 1 between the pistons 4 and 5 causes one of the pistons to lock so that it cannot rotate by means of the one-way clutch 11 with respect to the end flange 10, and the other to lock with respect to the coupler 15. As a consequence, the whole construction, i.e. the casing, end flanges and one of the pistons, rotates with respect to the coupler 15, whereby the power of the rotating motion can be transmitted to an appropriate actuator through the casing 8 and end flanges 10. Correspondingly, when pressure fluid is fed into the other space between the pistons, the pistons connect the other way round, i.e. the piston that connected non-rotatably to the end flange in the previous stage now connects non-rotatably to the fastener at its side and the other piston connects to the end flange instead of to the fastener. As a result of the feed of pressure fluid the casing 8, end flanges 10 and one of the pistons again rotate in the same direction with respect to the fasteners 15. In this embodiment the one-way clutches 11 and 12 function as locking members by means of which the shafts, depending on their use, can be locked so that they cannot rotate with respect to the casing and end flanges forming the cylinder space, so as to produce a continuous rotating motion.

FIGS. 4*a* to 4*c* illustrate another embodiment of the invention. In this embodiment the piston 4 is fixedly mounted on the casing 8, and only the piston 5 is arranged to rotate around the shaft. In the figure, the same reference numerals are used to designate the same members in FIGS. 1–3.

In this embodiment the piston 5 is mounted fixedly on the casing 8, whereby they form a uniform part, and only the piston 4 rotates with the shaft 2. When pressure fluid is fed into the space V1 via the channel 6, the piston 4 rotates forwards around the shaft while the rotating motion is transmitted through the one-way clutches in the same way as in FIGS. 1 to 3. When pressure fluid is fed into the space V2 via the channel in the shaft 3, the piston 5 moves away from the piston 4 rotating around the shaft, simultaneously rotating the casing. The shaft 3 connected to the casing and its end flange then transmits the rotating motion forwards according to the principle described above.

Figure 4:
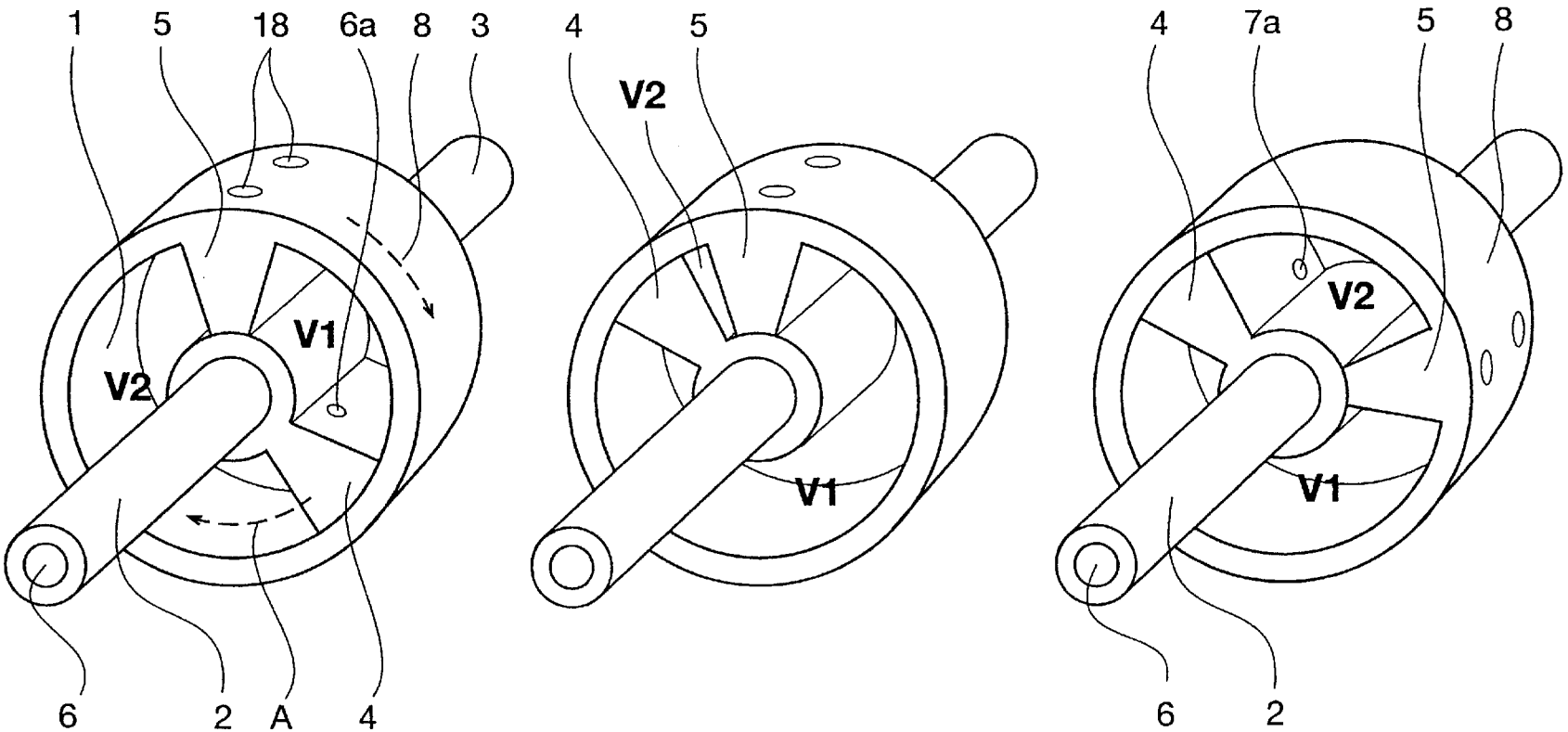
Figure 5:
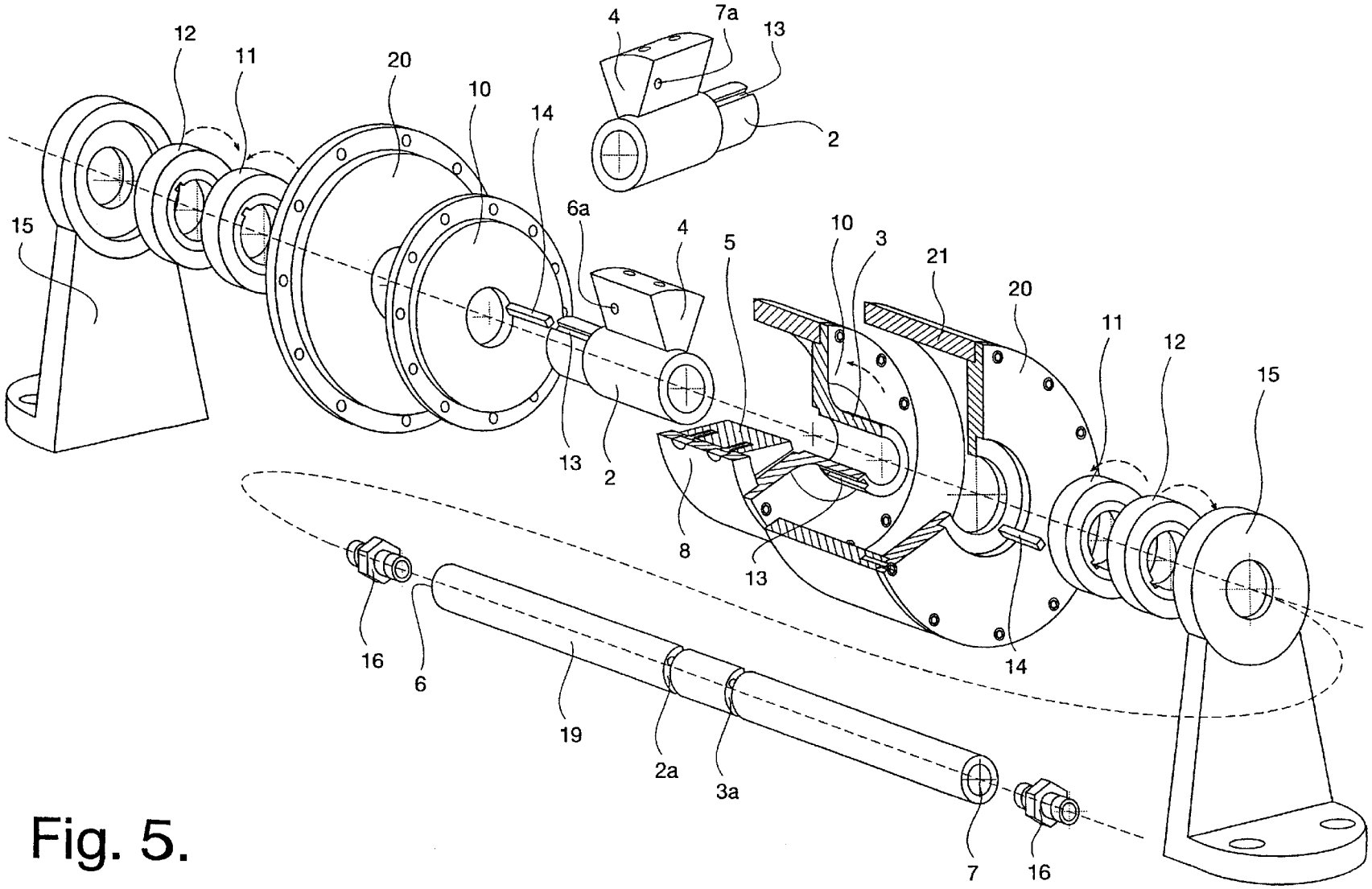
FIG. 5 is a schematic exploded view of another embodiment of the power unit illustrated in FIGS. 4*a* to 4*c*.

FIG. 5 is an exploded view of a practical embodiment of the embodiment shown in FIGS. 4*a*–4*c*. In this embodiment the power unit comprises an auxiliary shaft 19, around which the entire power unit is arranged to rotate. The auxiliary shaft 19 goes through the shafts 2 and 3 so that they can rotate around the auxiliary shaft 19. At the ends of the auxiliary shaft 19 there are channels 6 and 7 extending inside the shaft, but only the channel 7 is shown in FIG. 5. For the pressure fluid, there are openings 6*a* and 7*a* on the both sides of the piston 4 and channels extending through the shaft 2, the channels being almost parallel with the radius. At the ends of the channels there are pressure fluid grooves 2*a* and 3*a* in the auxiliary shaft 19. These grooves are intended to correspond to the channels in the shaft 2 of the piston 4, so that pressure fluid can be optionally fed into either side of the piston via the channels 7 and 6.

FIG. 5 further shows auxiliary flanges 20 and an auxiliary casing 21 which form a uniform housing around the casing 8 so as to provide power transmission. In this arrangement the one-way clutches 11 are connected to the auxiliary flanges 20 of the casing 8 of the cylinder space instead of the end flanges 10, whereby they function is as was explained in connection with FIGS. 1 to 3, except that the power is transmitted from the shaft 2 and 3 to the auxiliary flanges 20 in such a manner that the arrangement formed by the auxiliary flanges 20 and the auxiliary casing 21 rotates around the piston 4 or the piston 5 while the casing 8 rotates around the auxiliary shaft 19 with respect to the fasteners 15.

Figure 6:
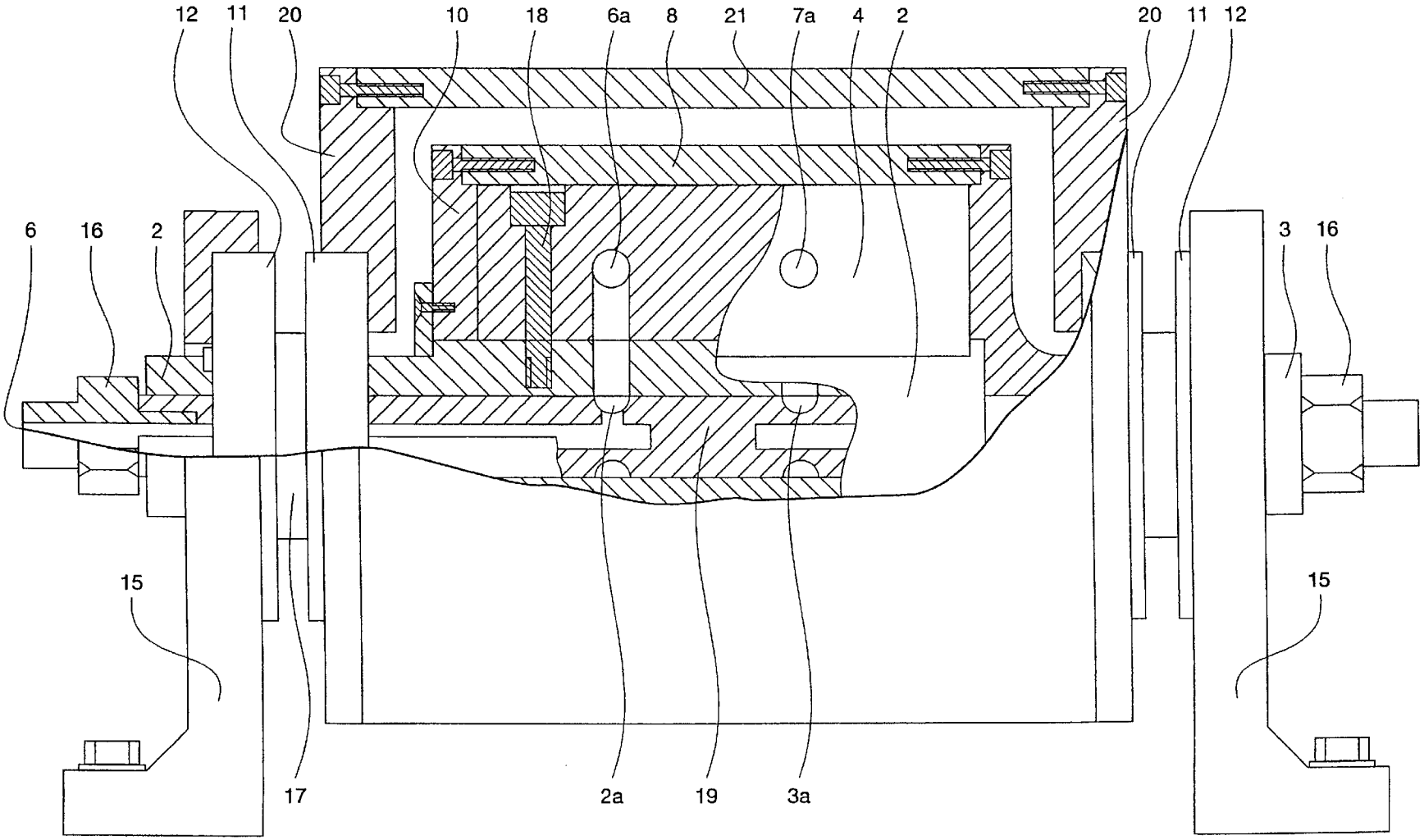
FIG. 6 is a schematic, partially sectional view of the embodiment of FIG. 5 in the direction of the shaft.

FIG. 6 is a schematic, partially sectional side view of the power unit of FIG. 5 in the direction of the shaft. As is seen in FIG. 6, the auxiliary casing 21 and the auxiliary flanges 20 form a housing around the casing 8 and the end flanges 10. The piston 4 is mounted on the shaft 2, which rotates around the auxiliary shaft 19. The channel 6 extends through the pressure fluid groove 2*a* in the auxiliary shaft 19 to the axial channel leading to the channel opening 6*a*, whereby pressure fluid can flow into the groove 2*a* along the channel 6 and from the opening 6*a* to the chamber V1 of the cylinder space 1. Correspondingly, on the other side of the piston 4 there is opening 7*a*, which is connected to the pressure fluid groove 3*a* so that pressure fluid can be fed via the channel 7 at the other end of the auxiliary shaft 19 through the opening 7*a* to chamber V2 of the cylinder space 1. Thus the pistons rotating alternately around the auxiliary shaft 19 cause the cylinder formed by the auxiliary flanges 20 and the auxiliary casing 21 to rotate in the desired direction.

Instead of a separate auxiliary casing 21 and auxiliary flanges 20 it is possible to use an arrangement in which one of the auxiliary flanges and the auxiliary casing 21 are formed as an integral part. It is also possible to use two cylinder halves which both comprise one auxiliary flange 20 and a casing-like part separating cylindrically from it, the casing-like parts of two such pieces being joined together so that they form a uniform cylinder. Furthermore, instead of a closed auxiliary casing 21 it is possible to use one or more fasteners spaced from one another on the cylinder circumference, the fasteners interconnecting the auxiliary flanges 20.

FIGS. 7*a* and 7*b* are schematic general views of some embodiments of the power unit of the invention. These show how pistons can be arranged in such a manner that the same power unit comprises several pistons which are mounted symmetrically with respect to the rotating axis. Thus there are two pairs of pistons in both figures. The pistons of each pair are mounted symmetrically with respect to the rotational axis so that they are in balance. FIG. 7*a* illustrates application of the embodiment of the invention according to FIGS. 1 to 3, where all pistons rotate with respect to the casing of the cylinder space, whereas FIG. 7*b* illustrates application of the embodiment of the invention according to FIGS. 4 to 6, where half of the pistons rotate around a separate shaft and half of the pistons are arranged non-rotatably with respect to the casing 8 of the cylinder space.

According to this principle, pistons may be arranged in groups containing several pistons. In that case the most obvious embodiment is one in which the pistons of both the groups are arranged symmetrically with respect to the rotational axis according to the principle shown in FIGS. 7*a* and 7*b*. When several pistons are used, it is possible to provide a motor or a pump which is powerful for its size, functions accurately and is easy and simple to use as a stepper motor or a feeding pump. In these cases, feeding of pressure fluids into the spaces between the pistons can also be implemented as disclosed above or in another way known per se.

The invention can be implemented in various ways. It is not necessary to use two separate end flanges in the device, but one of the end flanges and the casing may be formed as an integral part. The axial cross-section of the pistons is preferably such that their sides are parallel with the radii of the rotational axis, even though cross-sections of other kinds can also be used. The size of the pistons may also vary.

Instead of two pistons, three or more pistons can also be used, if so desired. In these embodiments it is, however, sometimes necessary to use shafts arranged within each other for transmitting the rotational motion. Correspondingly, if there are several pistons fastened onto the same shaft, it is possible to generate power multiplied by the number of the pistons. If the number of pistons is even, they are preferably arranged in two groups with respect to the rotational axis and the groups are arranged symmetrically.

Instead of the one-way clutches, it is possible to use locking members of other kinds, such as different clutches, brakes or latching mechanisms. Similarly, different timers can be used for feeding the pressure fluid so as to regulate the feeding, which produces a smooth motion and accurate stepping. In these embodiments it may be necessary to use separate controls to operate the locking members so that the power unit operates as a motor or a pump in the desired way.

When one-way clutches are used, they simultaneously function as the bearings of the pistons, but when locking members of other kinds are used, the mounting may have to be implemented differently. Even though mounting implemented with slide bearings may be sufficient in some cases, conventional bearings of other kinds can also be mounted on the shafts of the pistons.

The arrangement with auxiliary shafts shown in FIGS. 4 to 6 can also be applied to the embodiments shown in FIGS. 1 to 3.

It is possible to use different gases or gas mixtures, such as air, or different hydraulic fluids, such as oil, water, etc, as the pressure fluid in the power unit of the invention.

The channels for conveying pressure fluids into and out of the spaces between the pistons can be arranged to go through the shafts, through the shafts and the pistons, through the end flanges forming the walls of the cylinder space, or through the casing, in ways known per se.

The power unit of the invention can function as a feeding pump or as a stepper motor, since its motion from one position to another can be restricted. To produce a motion of the desired degree, the rotational motion of the shaft can be avoided by using different transmission mechanisms, or the motion can be restricted by using several pistons, by means of which it is possible to provide a deflection angle of the desired degree, and thus the extent of motion or the amount of the pressure fluid can be adjusted.

Instead of the external cylinder shown in FIGS. 5 to 6 it is also possible to transmit the power from the power unit with a separate secondary shaft or by using other known power transmissions.

What is claimed is:

1. A pressure fluid power unit comprising:

an annular casing defining a space therewithin, two radial pistons in said space defining first and second chambers between the pistons, said pistons being coaxially rotatable about an axis of said space, channels for conveying pressure fluid into and out of said chambers, transmission shafts respectively secured to said pistons, locking members for alternatively opposing rotation of one piston around said axis while the other piston is free to rotate, and means acting in synchronization with said locking members to (1) selectively supply pressure fluid into one of said chambers when rotation of said one piston is opposed and the other piston is free to rotate so that said one piston is at rest and the other piston is rotated to produce rotation of said transmission shaft associated with said other piston so that the power unit can serve as an intermittently driven motor or as a stepping motor and (2) to selectively drive said transmission shafts in rotation so that rotation of a first of said pistons is opposed and a second of said pistons is rotated to pressurize fluid in said first chamber for delivery by said power unit serving as a pump to produce when said power unit is serving as the pump or as the motor alternating successive halting and rotation of said pistons and flow of pressure fluid with respect to said first and second chambers.

2. A power unit as claimed in claim 1, wherein said locking members act on said transmission shafts.

3. A power unit as claimed in claim 2, comprising an output member driven in rotation by said transmission shafts when the power unit serves as a motor.

4. A power unit as claimed in claim 2, wherein said pistons are driven alternatively and successively in rotation to deliver the fluid under pressure from said space when the power unit serves as a pump.

5. A power unit as claimed in claim 1, wherein said channels extend through respective said transmission shafts into the associated pistons and have respective outlets communicating with said first and second chambers respectively.

6. A power unit as claimed in claim 1, wherein one of said pistons is fixed to said casing.

7. A power unit as claimed in claim 6, wherein said casing and said one of said pistons are rotatable around the axis of said space.

8. A power unit as claimed in claim 7, wherein said channels extend through said one of said pistons and have respective outlets which communicate with said first and second chambers.

9. A power unit as claimed in claim 1, comprising a plurality of further pistons, all of said pistons being even in number and arranged in two groups, one group being associated with one transmission shaft and the other group being associated with the other transmission shaft such that the pistons of one group are rotatable in unison relative to the pistons of the other group.

10. A power unit as claimed in claim 9, wherein the pistons of the two groups are symmetrically arranged relative to the axis of said space.

11. A power unit as claimed in claim 1, wherein said locking members comprise one way clutches to permit rotation of the pistons in one direction only.

12. A power unit as claimed in claim 1, wherein said locking members are braking means for slowing rotation of said pistons.

13. A power unit as claimed in claim 1, wherein said casing is fixed by at least one end flange secured to a side of the casing.

14. A power unit as claimed in claim 1, comprising an auxiliary shaft rotatably supporting said transmission shafts.

15. A power unit as claimed in claim 14, wherein said channels extend in said auxiliary shaft.

16. A power unit as claimed in claim 9, wherein one-half of said pistons are fixed to said casing.

17. A power unit as claimed in claim 1, wherein said locking members operate in alternation in successive operation steps to lock one said piston while the other said piston is free to rotate in one operation step and vice versa in a subsequent operation step.

18. A power unit as claimed in claim 1, wherein said channels are arranged to convey pressure fluid into and out of said chambers in any position of the pistons.

* * * * *